United States Patent [19]

Benning

[11] Patent Number: 4,881,853

[45] Date of Patent: Nov. 21, 1989

[54] SUPPORT SECTION FOR MINES AND TUNNELS

[76] Inventor: Günter Benning, Bruchweg 20, D 4350 Recklinghausen, Fed. Rep. of Germany

[21] Appl. No.: 196,214

[22] PCT Filed: Aug. 14, 1987

[86] PCT No.: PCT/EP87/00448

§ 371 Date: Jun. 27, 1988

§ 102(e) Date: Jun. 27, 1988

[87] PCT Pub. No.: WO88/01680

PCT Pub. Date: Mar. 10, 1988

[30] Foreign Application Priority Data

Aug. 28, 1986 [DE] Fed. Rep. of Germany ..... 3629214

[51] Int. Cl.[4] ..... E21D 17/00

[52] U.S. Cl. ..... 405/288; 405/150

[58] Field of Search ..... 405/288, 150, 146, 148, 405/151, 153, 259

[56] References Cited

U.S. PATENT DOCUMENTS

| | | | |
|---|---|---|---|
| 2,749,713 | 6/1956 | Paurat | 405/288 |
| 2,780,067 | 2/1957 | Jacobi et al. | 405/288 |
| 3,076,672 | 2/1963 | Heintzmann et al. | 405/288 X |
| 3,163,011 | 12/1964 | Groetschel | 405/288 |

FOREIGN PATENT DOCUMENTS

| | | |
|---|---|---|
| 3307230 | 10/1983 | Fed. Rep. of Germany . |
| 2322259 | 3/1977 | France . |
| 786538 | 11/1957 | United Kingdom . |
| 845429 | 8/1960 | United Kingdom . |
| 982030 | 2/1965 | United Kingdom . |

*Primary Examiner*—David H. Corbin

*Attorney, Agent, or Firm*—McGlew and Tuttle

[57] ABSTRACT

A support section for mines and tunnels comprises a section having two I-section portions with upper and lower abutting inner I-flanges. Each upper and lower flange has its outer edge joined together to form a box section. The box section has installation slots at spaced locations along both the upper I-flange and the lower I-flange. The installation slots are arranged along a central longitudinal axis at selected spaced locations and the top and bottom slots are advantageously aligned where their projections intersect at least in a vertical projection.

12 Claims, 2 Drawing Sheets

SUPPORT SECTION FOR MINES AND TUNNELS

FIELD AND BACKGROUND OF THE INVENTION

The invention relates in general to mining and in particular to a new and useful mine support section for a mine and tunnel support, comprising two I-sections, whose abutting inner flanges are joined together to form a box section.

There are various known support sections for the supports of mines, especially support of the face and the headway, which are able to perform the function of roof timbers and binding beams. This includes the preferred web sections, such as I-sections, trough sections and box sections, although the trough sections are used as a rule for gallery arches. During the process of their installations, either the sections must be supported by props or, when rock bolts are employed, it is necessary to suspend the sections from the hanging wall by means of butt straps reaching underneath the sections. Generally, the sections are joined together by butt straps which reach around and lie outside of the abutting ends. The props which are to be installed, like the butt straps, are a hindrance, for various reasons. Apart from the outlay of material, the props interfere with the making of upward and downward cuts, for example. The same applies to the sufficient propping of the transition from working face to gallery, particularly in the area of the machine room, as the props here curtail the space available for installation of drive units of the conveyors and excavating machinery. Finally, the continual laying and removing of props to support the binding beam sections in the area of the gallery parallel dam is expensive and bothersome. The underpinning of the support sections and their joining by means of butt straps arranged on the outside is a hindrance, since the sections are no longer suitable for use as running rails for transportation of machinery and materials, if need be. The invention proposes to remedy this.

SUMMARY OF THE INVENTION

The invention provides a support section for a mine and tunnel support which can be installed free of support, which enables an add-on of additional sections at the ends without exterior butt straps; and which can be used consequently as running rails.

According to the invention, a support has a box section with installation recesses in its upper I-flange and in its lower I-flange. The installation recesses are arranged at selected intervals on the central axis of the I-flanges; and the upper and lower installation recesses intersect each other, at least in vertical projection. In accordance with the invention, a box section is used as the support section, which can be adequately secured to the rock and especially to the hanging wall by means of rock bolts, e.g. expanding sleeve bolts, cement mortar bolts, or bolts embedded in plastic mortar. For this, the bolts can be installed through the installation recesses. Consequently, the support section of the invention can be installed without supports or propping, in either the lengthwise or the transverse direction of the face and the galleries. In addition, it is possible to join the section to its neighbor in the area of the abutting ends without an external butt strap. This is because the joining fixtures can be accommodated in the hollow spaces of the box sections being joined and, they can be locked after insertion in the hollow spaces via the installation recesses.

Inasmuch as the installation of the support section of the invention is done without supports or propping, there is now sufficient room available for unimpeded installation of conveyors and excavation machinery while making upward or downward cuts, as well as for installation of machine rooms, while the laying and removing of props is eliminated during production of gallery parallel dams. Furthermore, the support sections of the invention can be arranged one above the other and locked in the area of the installation recesss, regardless of whether the support sections are intersecting or parallel.

It is also possible to install suspension devices in the lower installation recesses of the centrally bolted support section. Finally, the add-on of gallery support sections and especially gallery arches, preferably in the transitional area from working face to gallery, presents no problems. Adequate security of the supported spaces is always assured by installation of the support sections of the invention as roof members or binding girders by means of rock bolts.

Preferably the invention calls for the inner flange of the upper and lower I-flanges being more narrow than the outer flange, e.g. half as wide. This enables a support section of relatively narrow construction, yet still a box section. Furthermore, the support section of the invention can also be installed in the conventional manner as a roof member or binding girder, that is, using a prop support, if such is absolutely necessary. Preferably, however, it should be suspended by means of rock bolts. For this reason, the invention has the upper and lower installation recesses an congruently aligned recesses, which facilitates the insertion of the bolt rods through the installation recesses. The support section is safeguarded by means of a bolt plate and bolt nut. Preferably, the installation recesses are fashioned as longitudinally extending holes and they are arranged, in vertical projection, symmetrically between the I-webs for the purpose of a central anchoring. The lengthwise holes assure the requisite clearance of motion for insertion of the bolt rods of the bolts already installed during the course of installing the support section. The distance between the installation recesses in this case may be twice as large as their length. In a preferred configuration of the invention with independent significance, the outer flanges of the I-flange are fashioned as running surfaces for loading equipment, and thus the support section of the invention also performs the function of a running rail. This is possible by virtue of the fact that the support section of the invention, dispensing with outer butt straps in the region of the abutting ends, can be joined to other support sections. Therefore, the sections can be put together to form an uninterrupted running rail without connection elements getting in the way. Likewise, this makes it possible to drive a boring device with a roof bolt emplacement device on the support section of the invention or the resulting running rail, which is thereby always available for emplacement of rock bolts wherever needed. By the same token, dam walling elements for creation of a pneumatic packing wall, or suchlike equipment, can be driven on the continuously laid running rails by means of running carriages, so that the support section of the invention can also be used to drive galleries. In order to allow a support by conventional props, the outer lengthwise edges of the outer flange are provided in a familiar manner, with recesses at a prescribed distance, forming toes, where the crown shaped heads of the props may obtain a purchase. Finally, the invention provides that coupling pieces can be installed in the box section of the invention at the end face, being able to swivel about the horizontal and/or vertical axis and locked in the region of the installation recesses as well as the swiveling joints. In this way, the support section of the invention can be installed as a rigidly coupled and extendible roof member.

The advantages achieved by the invention are primarily the creation of a support section for mine and tunnel support, which can be installed without support, that is, dispensing with props, outer butt straps, and other such underpinning. This unsupported installation is done by means of rock bolts, so that the support section of the invention is practically suspended from the hanging wall. Of course, an installation on the floor is also possible. The unsupported yet secure installation of the support section of the invention as a roof member or binding girder produces ample space and freedom of motion for making of upward or downward cuts, as well as in the transitional region from the working face to the gallery or the machine room. Furthermore, it is possible to construct gallery parallel dams without props. Moreover, the support section of the invention enables an add-on of support sections at the ends, without using outer butt straps, so that a continuous running rail for running gears and, consequently, transport of equipment and freight, is available. This is achieved by relatively simple and reliable means.

Accordingly, it is an object of the invention to provide a support section for mines and tunnels which includes a section which has two I-section portions with abutting upper and lower inner I-flanges which are joined together at their outer edges to form a box section. The section has installation slots on both the upper and lower I-flanges arranged at spaced locations and located so that the upper and lower slots intersect at least in a vertical projection.

A further object of the invention is to provide a support section for mine and tunnel supports which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
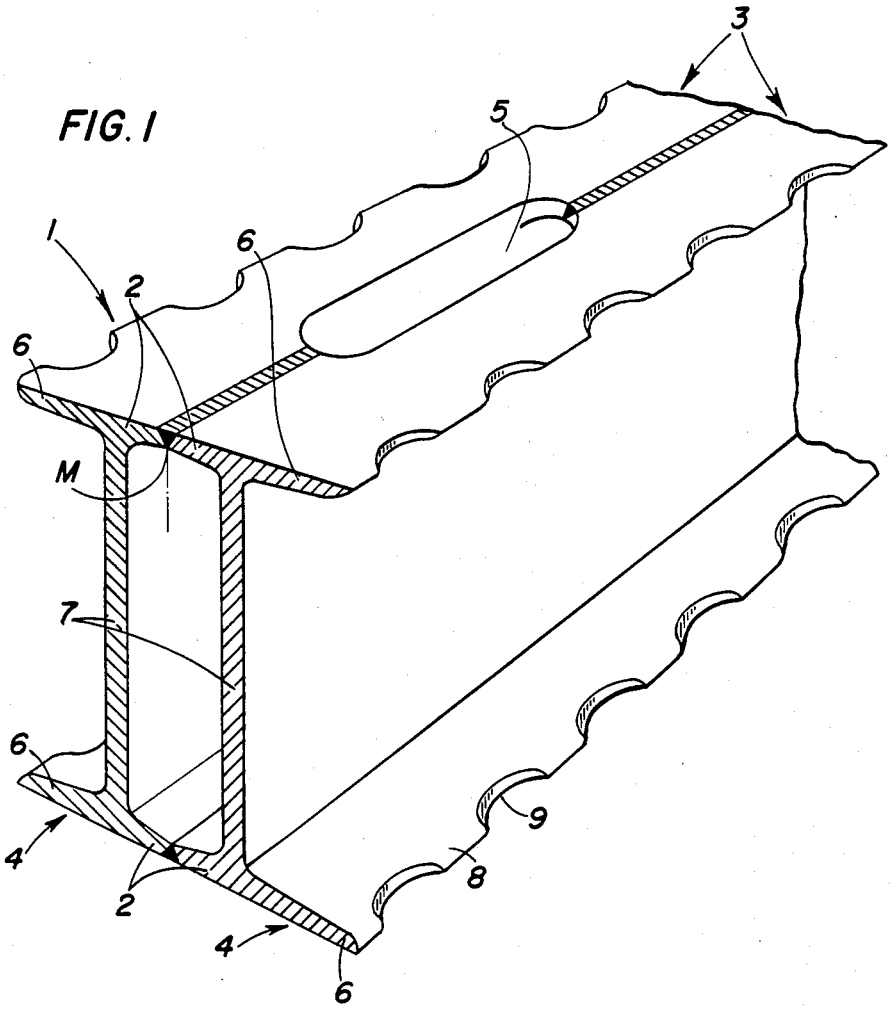
FIG. 1 is a support section as per the invention partly in section of a perspective view.
Figure 2:
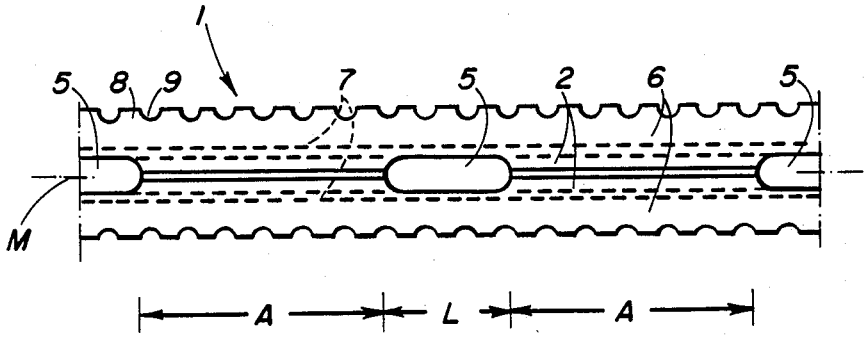
FIG. 2 is a top plan view of the section shown in FIG. 1 shown on a reduced scale.

Referring to the drawings, in particular the invention embodied therein as shown in FIG. 1 comprises a support section generally designated 1 which is formed with two I-sections 6,6 which have abutting upper and lower I- inner flanges 2 which are joined together to form a box section.

In the figures, a support section 1 for mine and tunnel support is shown, which in its basic construction comprises two I-sections, the abutting inner flanges 2 of which are joined together, e.g. welded, to form a box section. The box section has installation recesses or slots 5 in its upper I-flange 3 and in its lower I-flange 4.

The installation recesses 5 are arranged at given intervals on the central lengthwise axis M of the I-flanges 3 and 4. The upper and lower installation recesses 5 intersect in vertical projection. Preferably, the installation recesses 5 are aligned as congruent recesses. The inner flanges 2 of the upper and lower I-flanges 3 and 4 are more narrow than the outer flanges 6, e.g. half as wide, so that the I-section are asymmetrical steel sections, which are put together to form an axial symmetrical support section 1. The installation recesses 5 are formed as lengthwise holes or slots, arranged symmetrically between I-webs 7 in respect to a vertical projection. The distance A between the installation recesses 5 is, in the example, twice as large as their length L. The outer flanges 6 of the I-flanges 3,4 are formed as running surfaces for running gears, so that the support sections 1 of the invention can be put together without outer butt straps to form a running rail, the installation recesses 5 being joined at the rock bolt without props. For prop support, the outer lengthwise edges of the outer flanges 6 may be provided with recesses 9 at stipulated distances producing toes 8.

Figure 3:
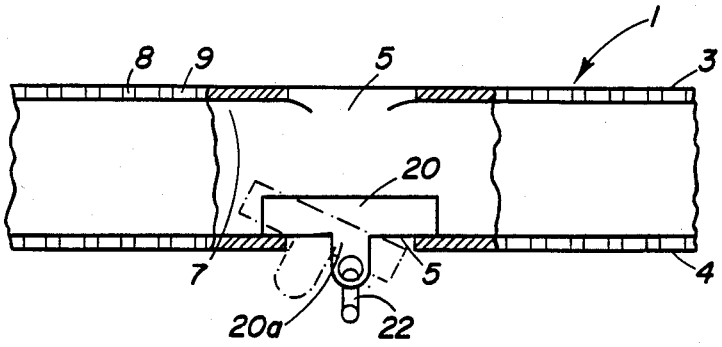
FIG. 3 is a partial lengthwise section through the section of FIG. 2 in the region of the installation recesses with a suspension installed.

A support 20 may be tilted (dotted lines) to enter into lower recess 5 as shown in FIG. 3 and positioned to suspend a chain 22 from a central portion **20*a*** as shown in FIG. 3.

Figure 4:
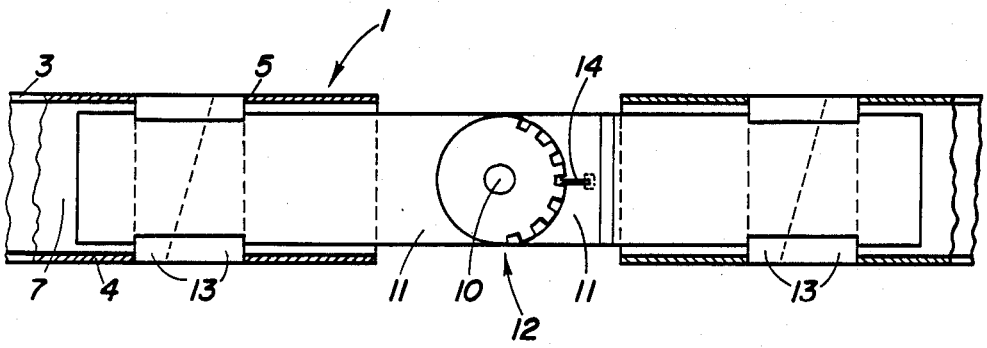
FIG. 4 is a partial lengthwise section through two coupled support sections, between which is interposed a coupling piece with a locking joint.
Figure 5:
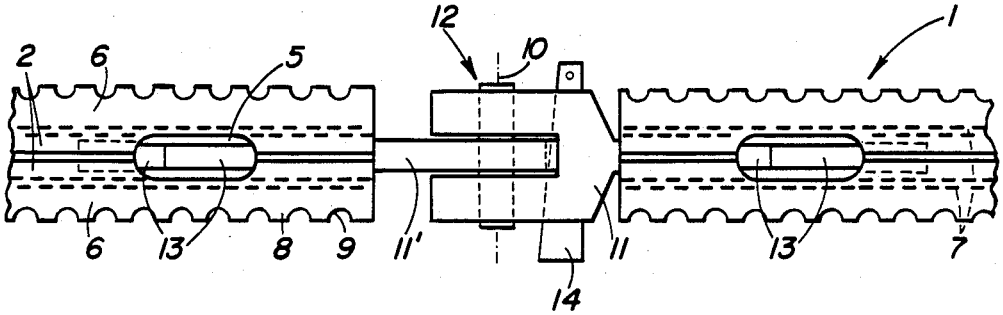
FIG. 5 is a top view of the coupled section of FIG. 4.

At the end face, coupling pieces 11, 11' are partially connected about either a horizontal and/or a vertical axis 10 (as shown in FIGS. 4 and 5). The pieces may be installed in the box section and or adjoining box sections, which can be locked in the area of the installation recesses 5 as well as in the area of their swiveling joints or pins 12, for example, by means of wedges 13 or 14.

While specific embodiments of the invention have been shown and described in detail to illustrate the application of the principles of the invention, it will be understood that the invention may be embodied otherwise without departing from such principles.

What is claimed is:

1. A support section for a mine and tunnel support, comprising: two I-section portions, each I-section portion having abutting upper and lower inner I-flanges, each inner I-flange having an outer edge joined to a cooperating inner I-flange to form a box section, said box section having installation slots in both said upper inner I-flange and in said lower inner I-flange, said installation slots being arranged at spaced locations along a central longitudinal axis of said upper and lower inner I-flanges and the slots of said upper and lower inner I-flanges being arranged such that slots of adjacent upper inner I-flanges and slots of adjacent lower inner I-flanges coincide forming installation recesses.

2. A support section according to claim 1, wherein inner I-flanges of said upper and lower I-flanges are narrower than outer flanges of said I-section portions and substantially half as wide as the outer flanges.

3. A support section according to claim 1, wherein the upper and lower slots are aligned.

4. A support section according to claim 1, wherein said slots extend along the longitudinal axis and are elongated in a longitudinal direction and arranged symmetricaly between said upper and lower I-flanges.

5. A support section according to claim 1, wherein said spacing between slots is twice as great as the length of each of said slots.

6. A support section according to claim 1, wherein said I-sections have outer flanges which form running surfaces for running gears.

7. A support section according to claim 1, wherein said I-sections each have outer flanges with edges having recesses therein at spaced locations.

8. A support section according to claim 1, including a pair of support sections arranged in end to end spaced relationship, first and second coupling pieces extending with ends into the box-shaped section of respective said support sections, coupling means for coupling said coupling pieces together said coupling means being arranged between said box-sections and being pivotally connected to said first and second coupling pieces.

9. A support section according to claim 8, wherein said coupling pieces extend out of each associated box section and said coupling means includes a coupling element coupling them together which permits pivoting motion at least about one of a vertical and horizontal axis.

10. A support section arrangement for a mine and tunnel support comprising: a support section formed of a first I-section portion and a second I-section portion, each of said first and second I-section portions having upper and lower inner I-flanges, upper and lower outer I-flanges and central I-webs, said upper inner I-flanges being joined together and said lower inner I-flanges being joined together to form a box section with said webs, each of said upper inner I-flanges defining upper slots, said upper inner I-flanges being joined such that an upper slot of said first I-section portion coincides with the upper slot of said second I-section portion defining an upper installation recess, said lower inner I-flanges each defining lower slots, said first I-section portion being joined to said second I-section portion such that lower slots coincide forming lower installation recesses.

11. A support section arrangement according to claim 10, further comprising a second support section, said second support section being substantially identical to said first support section; a first coupling piece extending into the box section of the first support section and a second coupling piece extending into the box section of the second support section; and, a coupling element pivotally joining said first and second coupling pieces allowing pivotal motion between said first and second support sections.

12. A support section arrangement according to claim 10, wherein said lower I-sections form rail portions defining a track.

* * * * *